US006374617B1

(12) United States Patent
Bonaquist et al.

(10) Patent No.: US 6,374,617 B1
(45) **Date of Patent: *Apr. 23, 2002**

(54) CRYOGENIC PULSE TUBE SYSTEM

(75) Inventors: Dante Patrick Bonaquist; Bayram Arman, both of Grand Island; Nancy Jean Lynch, North Tonawanda; Arun Acharya, East Amherst, all of NY (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/764,401

(22) Filed: Jan. 19, 2001

(51) Int. Cl.[7] ..... F25B 9/00; F01B 29/10
(52) U.S. Cl. ..... 62/6; 60/520
(58) Field of Search ..... 62/6; 60/520

(56) References Cited

U.S. PATENT DOCUMENTS 5,295,355 A 3/1994 Zhou et al. ..... 62/6
5,339,640 A * 8/1994 Reinke ..... 62/6
5,412,952 A 5/1995 Ohtani et al. ..... 62/6
5,435,136 A 7/1995 Ishizaki et al. ..... 60/517
5,711,156 A 1/1998 Matsui et al. ..... 62/6
5,813,234 A 9/1998 Wigharbd ..... 62/6
6,205,812 B1 * 3/2001 Acharya et al. ..... 62/607
6,269,658 B1 * 8/2001 Royal et al. ..... 62/643

OTHER PUBLICATIONS

Johnson et al., "Cryocooler Coldfinger Heat Interceptor", Cryocoolers 8 (1995) pp 709–717.
Marquavdt et al., "Vapor Precooling in a Pulse Tube Liquefier", 11 th International Cryocooler Conference (2000).
Radebaugh et al., "Regenerator Behavior with Heat Input or Removal at Intermediate Temperatures", 11 th International Cryocooler Conference (2000).

* cited by examiner

*Primary Examiner*—William C. Doerrler
(74) *Attorney, Agent, or Firm*—Stanley Ktorides

(57) ABSTRACT

A pulse tube system especially useful for producing and delivering refrigeration at very cold temperatures wherein a product fluid such as hydrogen is preferably precooled and then liquefied, subcooled and/or densified by heat exchange with ultra cold gas generated by a pulsing compression wave which rejects heat into a cryogen fluid heat sink.

10 Claims, 6 Drawing Sheets

CRYOGENIC PULSE TUBE SYSTEM

TECHNICAL FIELD

This invention relates generally to refrigeration and, more particularly, to the generation and use of refrigeration at a very cold temperature such as is needed to cool, liquefy and/or subcool or densify fluids such as hydrogen and oxygen.

BACKGROUND ART

The cooling, liquefaction and/or subcooling or densification of certain gases such as neon, hydrogen or helium requires the generation of very low temperature refrigeration. For example, at atmospheric pressure neon liquefies at 27.1 K, hydrogen liquefies at 20.39K, and helium liquefies at 4.21 K. The generation of such very low temperature refrigeration is very expensive. Inasmuch as the use of fluids such as neon, hydrogen and helium are becoming increasingly important in such fields as energy generation, energy transmission, and electronics, any improvement in systems for the liquefaction of such fluids would be very desirable. Another application is cooling of superconducting systems. Densification of propellants such as hydrogen and oxygen for reusable launch vehicles is another application. It allows larger payloads per space flight and requires subcooling of liquid hydrogen near its triple point which is around 14K.

Accordingly, it is an object of this invention to provide an improved system for generating and providing refrigeration for cooling, liquefying and/or subcooling or densifying fluids such as neon, hydrogen, oxygen or helium.

SUMMARY OF THE INVENTION

The above and other objects, which will become apparent to those skilled in the art upon a reading of this disclosure, are attained by the present invention, one aspect of which is:

A method for providing refrigeration to a product fluid comprising:

(A) compressing pulse tube gas to produce hot compressed pulse tube gas, cooling the hot compressed pulse tube gas, and further cooling the cooled compressed pulse tube gas by direct contact with cold heat transfer media to produce cold pulse tube gas and warmed heat transfer media;

(B) expanding cold pulse tube gas to produce ultra cold pulse tube gas and to produce a gas pressure wave which compresses and heats pulse tube working fluid, and extracting heat from the heated pulse tube working fluid by indirect heat exchange with cooling fluid to produce warmed cooling fluid;

(C) providing refrigeration to product fluid by passing product fluid in indirect heat exchange with the ultra cold pulse tube gas; and (D) intercepting heat within the heat transfer media by indirect heat exchange with cryogen fluid to produce warmed cryogen fluid.

Another aspect of the invention is:

Apparatus for providing refrigeration to a product fluid comprising:

(A) a regenerator having a regenerator heat exchanger and a regenerator body containing heat transfer media, and means for generating pressurized gas for oscillating flow within the regenerator;

(B) a pulse tube comprising a pulse tube heat exchanger and a pulse tube body, and means for passing cooling fluid to the pulse tube heat exchanger;

(C) means for passing gas between the regenerator body and the pulse tube body, a product fluid heat exchanger employing fluid from the pulse tube, and means for recovering product fluid from the product fluid heat exchanger in a refrigerated condition; and (D) means for passing cryogen fluid to the regenerator heat exchanger, and means for withdrawing cryogen fluid from the regenerator heat exchanger.

As used herein the term "liquefy" means to change a vapor to a liquid and/or to subcool a liquid.

As used herein the term "subcool" means to cool a liquid to be at a temperature lower than the saturation temperature of that liquid for the existing pressure.

As used herein the term "ultra cold" means having a temperature of 90° K. or less.

As used herein the term "indirect heat exchange" means the bringing of fluids into heat exchanger relation without any physical contact or intermixing of the fluids with each other.

DETAILED DESCRIPTION

In general the invention comprises the use of a pulse tube refrigeration system, which uses a cryogen fluid as a heat sink, to generate ultra cold gas for use to cool, liquefy and/or subcool or densify a product fluid which preferably has been precooled prior to entering the pulse tube system. In a preferred embodiment the cryogen fluid also serves as a cooling fluid for carrying out the product fluid precooling. The cryogen fluid serves to cool the heat transfer media within the regenerator body of the pulse tube refrigeration system serving as a heat sink to assist in generating the ultra cold refrigeration.

Figure 1:
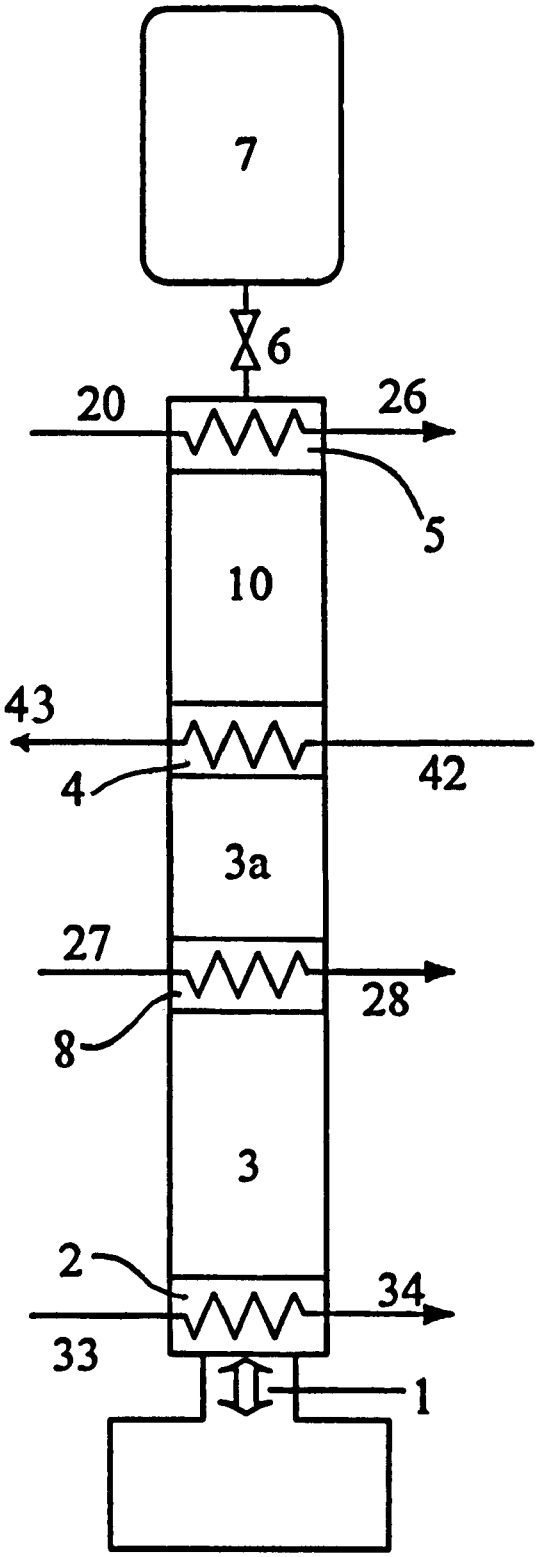
FIG. 1 is a representation of one preferred embodiment of the pulse tube refrigeration system of this invention.

Referring now to FIG. 1 regenerator 3, 3*a* contains pulse tube gas which may be hydrogen, neon, nitrogen, a mixture of helium and neon, a mixture of neon and nitrogen, or a mixture of helium and hydrogen. Mixtures of helium and hydrogen are preferred.

A pulse, i.e. a compressive force, is applied to the hot end of regenerator section 3 as illustrated in representational form by pulse arrow 1 thereby initiating the first part of the pulse tube sequence. Preferably the pulse is provided by a piston which compresses a reservoir of pulse tube gas in flow communication with regenerator section 3. Another preferred means of applying the pulse to the regenerator is by the use of a thermoacoustic driver which applies sound energy to the gas within the regenerator. Yet another way for applying the pulse is by means of a linear motor/compressor arrangement. Yet another means to apply pulse is by means of a loudspeaker. Another preferred means to apply pulse is by means of a travelling wave engine. The pulse serves to compress the pulse tube gas producing hot pulse tube gas at the hot end of the regenerator. The hot pulse tube gas is cooled by indirect heat exchange with heat transfer fluid 33 in heat exchanger 2 to produce warmed heat transfer fluid in stream 34 and to produce cooled compressed pulse tube gas for passage through the remainder of the regenerator, i.e. the regenerator body. Examples of fluids useful as the heat transfer fluid in the practice of this invention include water, air, ethylene glycol and the like. Preferably, as in the embodiment of the invention illustrated in FIG. 1, the cooled compressed pulse tube gas is further cooled by indirect heat exchange with cryogen fluid 27, 28 in regenerator heat exchanger 8. The preferred cryogen fluid in the practice of this invention is liquid nitrogen. Other cooling fluids which may be used include atmospheric gases such as argon, oxygen, air and carbon dioxide; hydrocarbons such as methane, ethane, ethylene, propane, propylene, liquefied natural gas and liquefied petroleum gas; fluorocarbons and hydroflurorcarbons such as carbon tetrafluoride and fluoroform; fluoroethers and hydrofluoroethers.

The regenerator body contains heat transfer media. Examples of suitable heat transfer media in the practice of this invention include steel balls, wire mesh, high density honeycomb structures, expanded metals, lead balls, copper and its alloys, complexes of rare earth element(s) and transition metals.

The heat transfer media is at a cold temperature, generally within the range of from 3 to 150K at the cold end to 20 to 330 K at the warm end, having been brought to this cold temperature in the second part of the pulse tube sequence which will be described more fully below. In addition heat is removed from the heat transfer media by indirect heat exchange with cryogen fluid in the regenerator heat exchanger thus serving to intercept heat within the heat transfer media. As the cooled compressed pulse tube gas passes through the regenerator body, it is further cooled by direct contact with the cold heat transfer media to produce warmed heat transfer media and cold pulse tube gas, generally at a temperature within the range of from 4 to 151 K at the cold end to 21 to 331 K at the warm end.

The cold pulse tube gas is passed from the regenerator to pulse tube 10 at the cold end. Pulse tube 10 has a pulse tube heat exchanger 5 at a distance from where the cold pulse tube gas is passed into the pulse tube. As the cold pulse tube gas passes into pulse tube 10 at the cold end, it generates a gas pressure wave which flows toward the warm end of pulse tube 10 and compresses the gas within the pulse tube, termed the pulse tube working fluid, thereby heating the pulse tube working fluid.

Cooling fluid 20 is passed to pulse tube heat exchanger 5 wherein it is warmed or vaporized by indirect heat exchange with the pulse tube working fluid, thus serving as a heat sink to cool the pulse tube working fluid. Resulting warmed or vaporized cooling fluid is withdrawn from pulse tube heat exchanger 5 in steam 26. Preferably cooling fluid 20 is water. Other cooling fluids which may be used in the practice of this invention include ethylene glycol, water/glycol mixtures, atmospheric gases such as argon, oxygen, air and carbon dioxide; hydrocarbons such as methane, ethane, ethylene, propane, propylene; liquefied natural gas; liquefied petroleum gas; fluorocarbons and hydrofluorocarbons such as carbon tetrafluoride and fluoroform; and selected fluoroethers and hydrofluoroethers.

Attached to the warm end of pulse tube 10 is a line having orifice 6 leading to reservoir 7. The compression wave of the pulse tube working fluid contacts the warm end wall of the pulse tube and proceeds back in the second part of the pulse tube sequence. Orifice 6 and reservoir 7 are employed to maintain the pressure and flow waves in phase so that the pulse tube generates net refrigeration during the expansion and the compression cycles in the cold end of pulse tube 10. Other means for maintaining the pressure and flows waves in phase which may be used in the practice of this invention include inertance tube and orifice, expander, linear alternator and bellows arrangements. In the expansion sequence, the pulse tube gas expands to produce ultra cold pulse tube gas at the cold end of the pulse tube 10. The expanded gas reverses its direction such that it flows from the pulse tube toward regenerator 3, 3*a*.

Preferably product fluid is helium, hydrogen, neon, nitrogen, argon, oxygen, krypton, xenon or methane. Mixtures comprising one or more of neon, hydrogen, helium, nitrogen, argon, oxygen, methane. and carbon tetrafluoride are other examples of product fluids which may be liquefied in the practice of this invention. Product fluid 42, which may have been precooled, is passed to product fluid heat exchanger 4 wherein it is cooled, liquefied and/or subcooled or densified by indirect heat exchange with ultra cold pulse tube gas. The resulting product fluid is recovered from product fluid heat exchanger 4 in stream 43.

The pulse tube gas emerging from product fluid heat exchanger 4 is passed to regenerator 3*a*, 3 wherein it directly contacts the heat transfer media within the regenerator body to produce the aforesaid cold heat transfer media, thereby completing the second part of the pulse tube refrigerant sequence and putting the regenerator into condition for the first part of a subsequent pulse tube refrigeration sequence.

In the practice of this invention the pulse tube body contains only gas for the transfer of the pressure energy from the expanding pulse tube gas at the cold end for the heating of the pulse tube working fluid at the warm end of the pulse tube. That is, pulse tube 10 contains no moving parts such as are used with a piston arrangement. The operation of the pulse tube without moving parts is a significant advantage of this invention. As discussed previously, the pulse tube may have a taper to aid adjustment of the proper phase angle between the pressure and flow waves. In addition, the pulse tube may have a passive displacer to help in separating the ends of the pulse tube.

Figure 2:
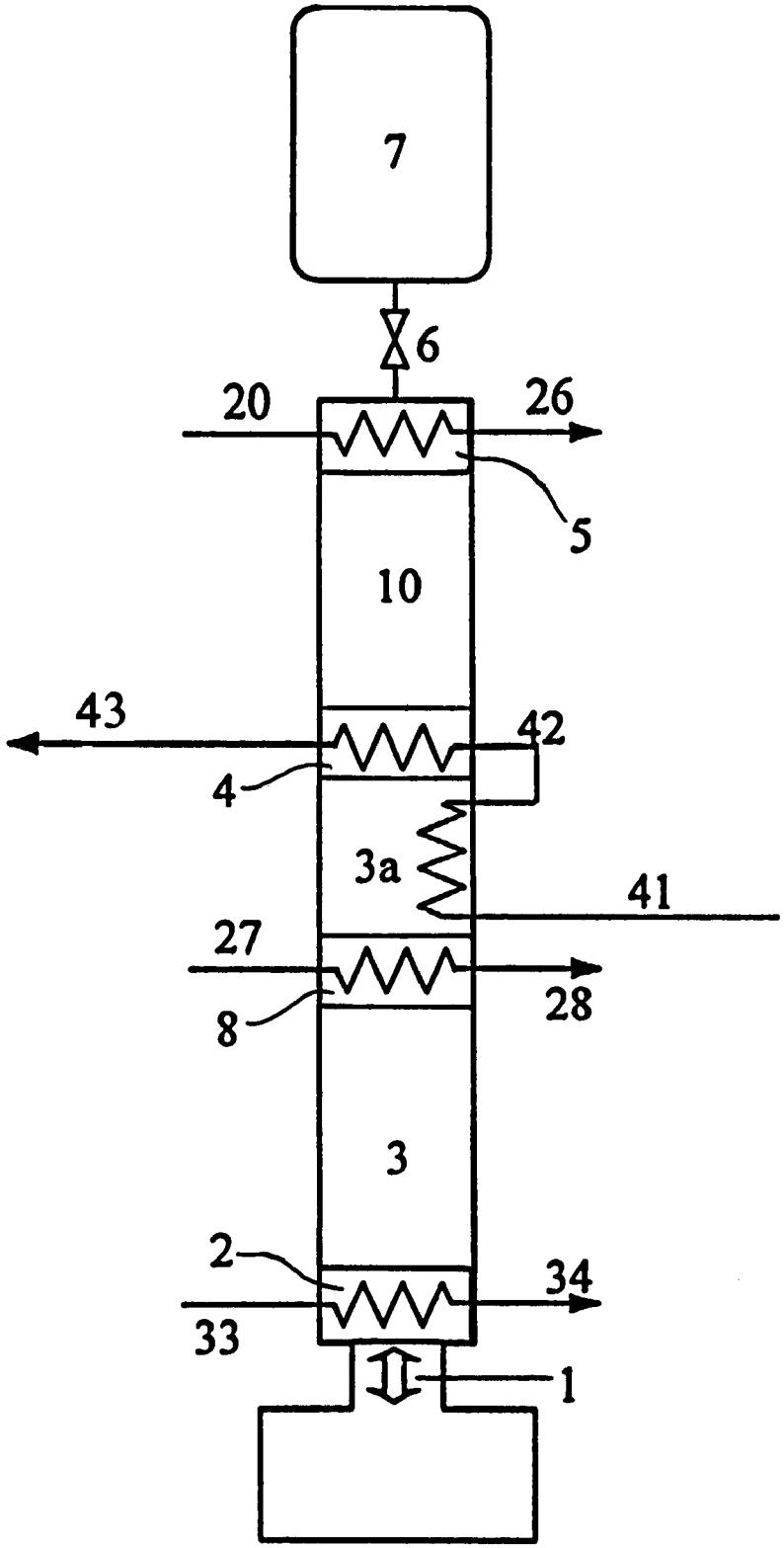
FIGS. 2–5 illustrate variations of the embodiment of the invention illustrated in FIG. 1. The numerals in FIGS. 1–5 are the same for the common elements.
Figure 3:
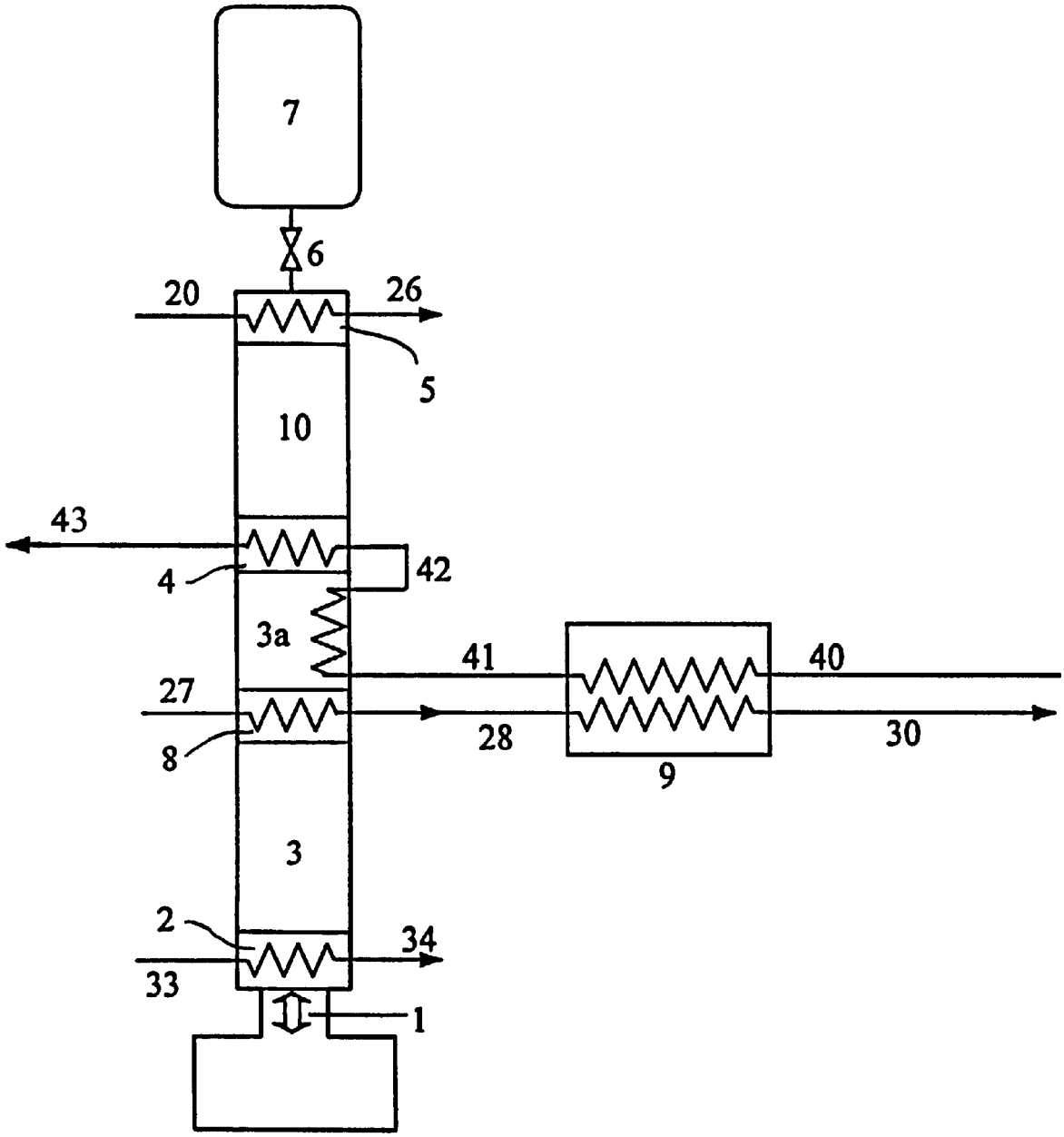
Figure 4:
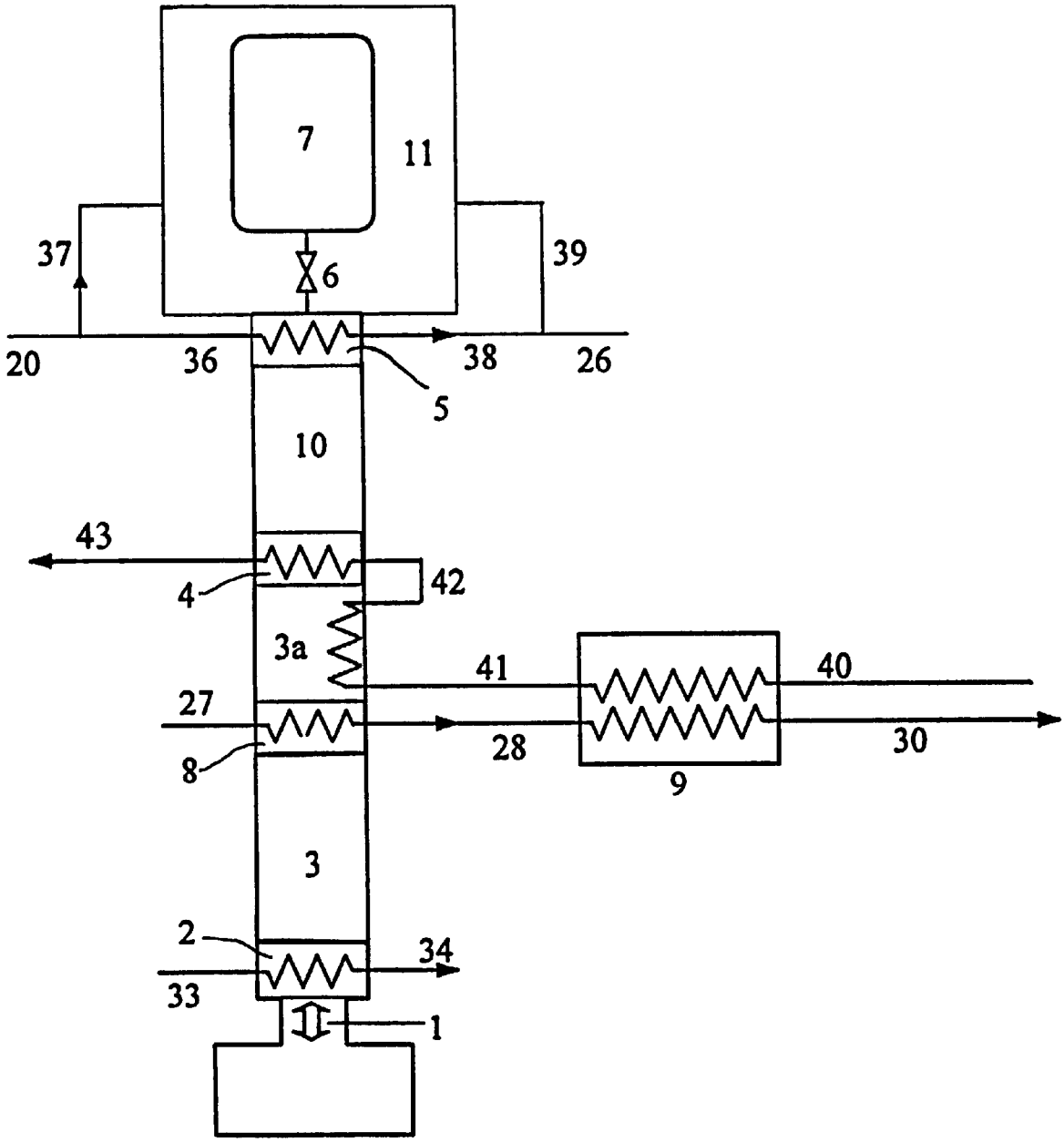
Figure 5:
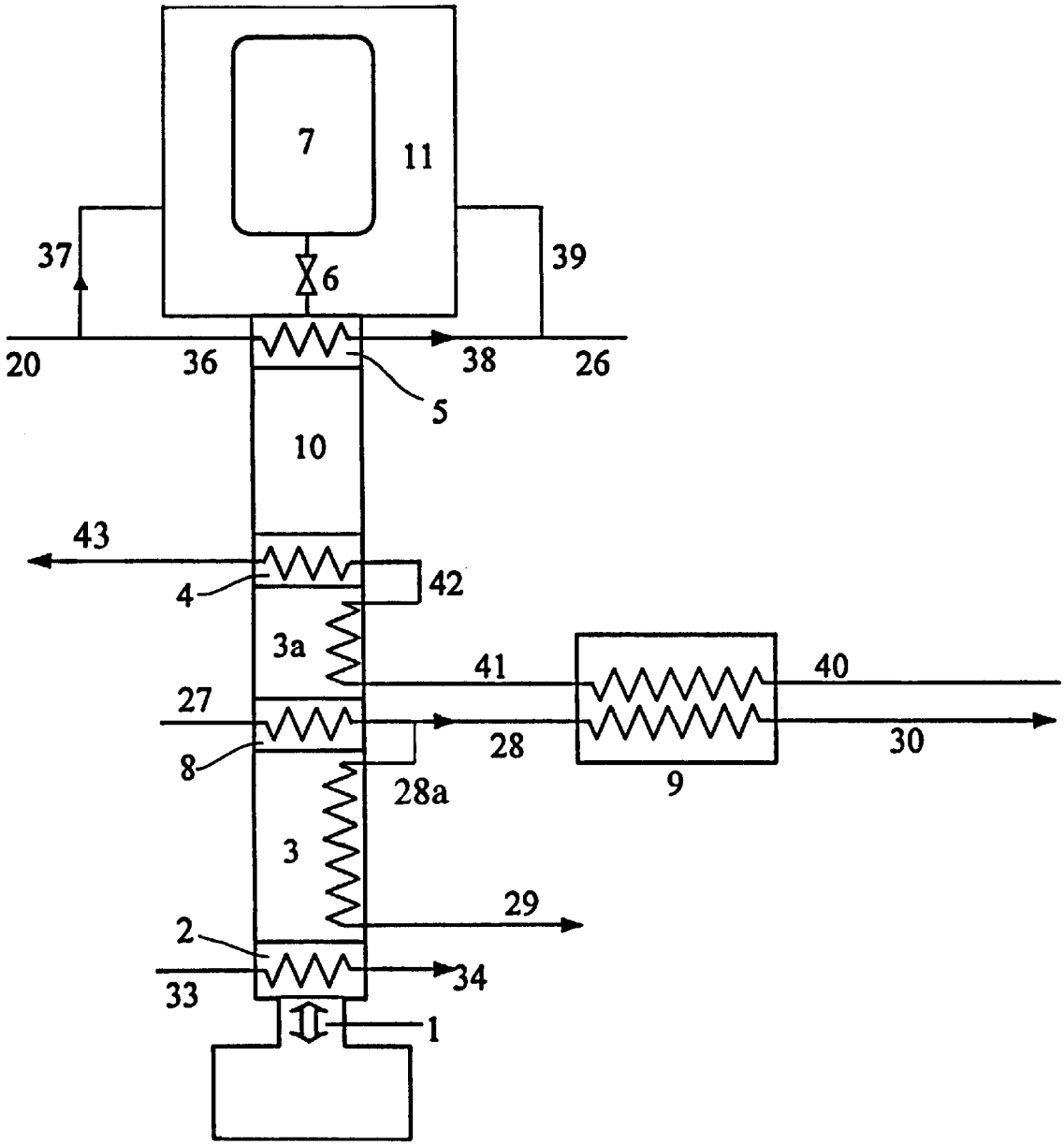

FIGS. 2–5 illustrate other preferred embodiments of the invention which are variations of the basic system illustrated in FIG. 1. A description of the common elements which have the same numeral will not be repeated. Referring now to FIG. 2, product fluid in line 41 is precooled by passage through regenerator portion 3*a* before being provided as stream 42 to product fluid heat exchanger 4. In the embodiment illustrated in FIG. 3 product fluid in stream 40 is precooled in recuperative heat exchanger 9 by indirect heat exchange with cryogen fluid 28 which emerges therefrom as stream 30. Resulting precooled product fluid 41 emerges from heat exchanger 9 and is further processed as previously described. In the embodiment illustrated in FIG. 4 cooling fluid 20 is divided into portion 37 and portion 36. Portion 36 is processed in heat exchanger 5 as previously described, emerging therefrom in stream 38. Portion 37 is passed into cryostat 11 to keep reservoir 7 and orifice 6 at a temperature below ambient, and is passed out of cryostat 11 in stream 39 which is combined with stream 38 to form stream 26. In the embodiment illustrated in FIG. 5 a portion 28*a* of stream 28 is used to cool pulse tube gas by indirect heat exchange in regenerator section 3, emerging therefrom as stream 29.

Figure 6:
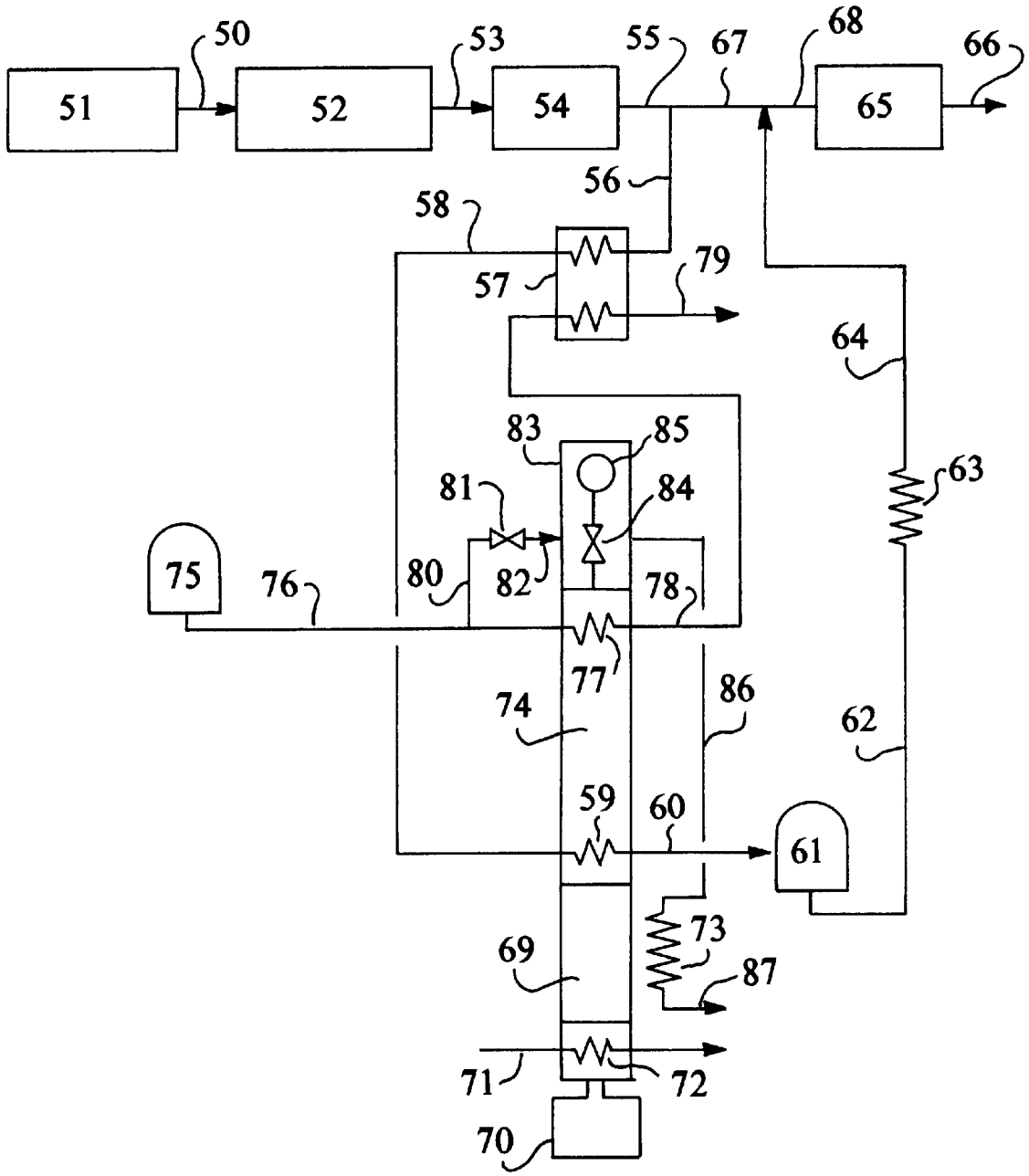
FIG. 6 is a representation of another preferred embodiment of the invention which also illustrates the invention as part of a supply system.

FIG. 6 illustrates the use of the invention to provide product fluid to a use point. In the system illustrated in FIG. 6, the product fluid is hydrogen and the cooling fluid used in the pulse tube heat exchange is also used to precool the product fluid.

Referring now to FIG. 6, water 50 from water treatment unit 51 is passed to electrolysis unit 52 wherein it is separated into oxygen and hydrogen. Hydrogen is passed in stream 53 from electrolysis unit 52 to purifier 54 and high purity hydrogen, having a hydrogen concentration generally of at least 90 mole percent, is withdrawn from purifier 54 in stream 55. At least some of the purified hydrogen, shown in FIG. 6 as stream 56, is used as the product fluid for the practice of the invention.

Hydrogen stream 56 is precooled by passage through precooler 57 by indirect heat exchange with cooling fluid and resulting precooled hydrogen product fluid in stream 58 is liquefied by passage through product fluid heat exchanger 59 by indirect heat exchange with ultra cold pulse tube gas. Resulting liquefied hydrogen product fluid is recovered in stream 60 which passes the liquefied hydrogen product fluid from product fluid heat exchanger 58 to liquid hydrogen storage tank 61. As required by the use point, liquid hydrogen is withdrawn from storage tank 61 in stream 62, vaporized by passage through vaporizer 63 and passed in stream 64 through filter 65 and then to the use point in stream 66. In the embodiment illustrated in FIG. 6, stream 64 is combined with stream 67, which is another portion of stream 55, to form combined stream 68 for passage through filter 65 and to the use point in stream 66. The use point could be, for example, a fuel cell where hydrogen and oxygen react to produce electricity, a chemical plant where hydrogen is used in a hydrogenation reaction, or a fabrication facility where hydrogen is used for heat treating.

A pulse is provided to regenerator 69 using linear motor 70 to compress pulse tube gas and produce hot pulse tube gas which is cooled by indirect heat exchange with cooling water 71 in heat exchanger 72, and is further cooled by indirect heat exchange with cryogen fluid passing through regenerator heat exchanger 73. The pulse tube gas is further cooled to a cold condition by direct contact with heat transfer media in regenerator 69 and then passed from regenerator 69 into pulse tube 74. As the cold pulse tube gas passes into pulse tube 74 at the cold end it compresses the gas in the pulse tube and pushes some of it into reservoir 85 via valve 84. Heat is removed by pulse tube heat exchanger 77. When the pressure at the pressure generator decreases to a minimum, then the expansion sequence starts. The gas within the pulse tube expands, lowering its temperature so as to form ultra cold pulse tube gas, and also generating a gas pressure wave which flows toward the warm end of pulse tube 74 thereby compressing the pulse tube working fluid within pulse tube 74 and heating the pulse tube working fluid.

Cooling fluid, in this case liquid nitrogen, is passed from liquid nitrogen storage tank 75 in stream 76 to pulse tube heat exchanger 77 wherein it is warmed by indirect heat exchange with the pulse tube working fluid, thus serving as a heat sink to cool the pulse tube working fluid. Resulting warmed cooling fluid is withdrawn from pulse tube heat exchanger 77 in stream 78 and passed to precooler 57 wherein it serves as the cooling fluid for precooling hydrogen product fluid stream 56. The further warmed cooling fluid is removed from the system as nitrogen stream 79.

A portion 80 of nitrogen cooling fluid stream 76 is passed through valve 81 and as stream 82 is passed into envelope 83 which houses orifice 84 and reservoir 85 which function in a manner similar to that described in conjunction with the embodiment illustrated in FIG. 1. Warmed cooling fluid is withdrawn from envelope 83 in stream 86 and passed to regenerator heat exchanger 73 where it serves as the cryogen fluid for removing heat from the heat transfer media by intercepting heat at some mid temperature, and also for cooling of the pulse tube gas as was previously described, and then for removal from the system in stream 87.

Although the invention has been described in detail with reference to certain preferred embodiments, those skilled in the art will recognize that there are other embodiments of the invention within the spirit and the scope of the claims. For example, the pulse tube could be composed of a number of tubes connected to a single regenerator to allow scale up of the overall system. In another embodiment there would be more than one inlet to the pulse tube. In another embodiment there would be an impedance tube in addition to the valve to adjust proper phase relationship between the flow and pressure waver. A ballast tank need not be employed in all embodiments. In yet another embodiment there would be more than one pulse tube stage with cryogen intercept.

What is claimed is:

1. A method for providing refrigeration to a product fluid comprising:

(A) compressing pulse tube gas to produce hot compressed pulse tube gas, cooling the hot compressed pulse tube gas, and further cooling the cooled compressed pulse tube gas by direct contact with cold heat transfer media to produce cold pulse tube gas and warmed heat transfer media;

(B) expanding cold pulse tube gas to produce ultra cold pulse tube gas and to produce a gas pressure wave which compresses and heats pulse tube working fluid, and extracting heat from the heated pulse tube working fluid by indirect heat exchange with cooling fluid to produce warmed cooling fluid;

(C) providing refrigeration to product fluid by passing product fluid in indirect heat exchange with the ultra cold pulse tube gas; and (D) intercepting heat within the heat transfer media by indirect heat exchange with cryogen fluid to produce warmed cryogen fluid.

2. The method of claim 1 wherein cryogen fluid is additionally employed for cooling the pulse tube gas to assist in producing the cold pulse tube gas.

3. The method of claim 1 wherein cryogen fluid is also employed for precooling the product fluid prior to said provision of refrigeration to the product fluid.

4. The method of claim 1 wherein the product fluid comprises hydrogen.

5. The method of claim 1 wherein the product fluid comprises neon.

6. The method of claim 1 wherein the cryogen fluid comprises nitrogen.

7. Apparatus for providing refrigeration to a product fluid comprising:

(A) a regenerator comprising a regenerator heat exchanger and a regenerator body containing heat transfer media, and means for generating pressurized gas for oscillating flow within the regenerator;

(B) a pulse tube comprising a pulse tube heat exchanger and a pulse tube body, and means for passing cooling fluid to the pulse tube heat exchanger;

(C) means for passing gas between the regenerator body and the pulse tube body, a product fluid heat exchanger employing fluid from the pulse tube and means for recovering product fluid from the product fluid heat exchanger in a refrigerated condition; and (D) means for passing cryogen fluid to the regenerator heat exchanger, and means for withdrawing cryogen fluid from the regenerator heat exchanger.

8. The apparatus of claim 7 further comprising means for passing cooling fluid from the pulse tube heat exchanger to a precooler for precooling product fluid.

9. The apparatus of claim 7 further comprising means for passing cryogen fluid from the regenerator heat exchanger in indirect heat exchange with heat transfer media within the regenerator.

10. The apparatus of claim 7 further comprising means for passing cryogen fluid from the regenerator heat exchanger to a precooler for precooling product fluid.

* * * * *